US006408763B1

(12) United States Patent
Hurtta et al.

(10) Patent No.: US 6,408,763 B1
(45) Date of Patent: Jun. 25, 2002

(54) APPARATUS FOR LAND, SEA, AND AIR DEFENSE

(75) Inventors: Tero Hurtta, Helsinki; Juhani Niinivaara; Tarmo Niinivaara, both of Koria, all of (FI)

(73) Assignee: Sea Valve Engineering Oy, Helsinki (FI)

( * ) Notice: Subject to any disclaimer, the term of this patent is extended or adjusted under 35 U.S.C. 154(b) by 0 days.

(21) Appl. No.: 09/701,172

(22) PCT Filed: Mar. 7, 2000

(86) PCT No.: PCT/FI00/00175

§ 371 (c)(1),
(2), (4) Date: Nov. 27, 2000

(87) PCT Pub. No.: WO00/63633

PCT Pub. Date: Oct. 26, 2000

(30) Foreign Application Priority Data

Apr. 20, 1999 (FI) ..... 990887

(51) Int. Cl.[7] ..... F42B 23/00
(52) U.S. Cl. ..... 102/404; 102/401
(58) Field of Search ..... 102/401, 404; 89/1.8

(56) References Cited

U.S. PATENT DOCUMENTS

| | | | | | |
|---|---|---|---|---|---|
| 3,403,624 | A | * | 10/1968 | Fosler et al. | 102/8 |
| 4,702,169 | A | * | 10/1987 | Gallant | 102/401 |
| 4,711,179 | A | * | 12/1987 | Sundberg | 102/426 |
| 4,714,021 | A | * | 12/1987 | Tranin | 102/401 |
| 5,133,260 | A | * | 7/1992 | Grosch | 102/401 |
| 5,206,653 | A | | 4/1993 | Westphal | |
| 5,677,506 | A | * | 10/1997 | Wallin | 89/38 |
| 6,079,334 | A | * | 6/2000 | Roheim | 102/394 |

FOREIGN PATENT DOCUMENTS

| | | |
|---|---|---|
| DE | 25 22 880 | 12/1976 |
| DE | 35 43 770 | 6/1992 |
| GB | 2 272 046 | 5/1994 |

* cited by examiner

*Primary Examiner*—Peter M. Poon
*Assistant Examiner*—Gabriel Sukman
(74) *Attorney, Agent, or Firm*—Young & Thompson

(57) ABSTRACT

An apparatus for land, sea, and air defense, including a cylinder setup opening into a cylinder mast formed by nested cylinders and equipped with a weapon container. The weapon container includes, depending on the intended use, various weapons that fire automatically as well as ammunition. A drill, with a power device, is connected to the opposite end of the cylinder setup and cylinder mast's weapon container for drilling a hole into the earth.

20 Claims, 9 Drawing Sheets

A - A

APPARATUS FOR LAND, SEA, AND AIR DEFENSE

BACKGROUND OF THE INVENTION

The object of this invention is a defense apparatus for land, sea, and air defense. With the help of the invention, firing and defense operation is carried out with no troops present on the site. The invention has several forms of operation. The surveillance of the surroundings can be done with automatic devices and the starting, duration, and ending of the firing is an independent operation, i.e., the invention can be called a robot.

DESCRIPTION OF THE RELATED ART

The traditional methods known in this field of technology are various mines, such as anti-tank mines, which are detonated by a load applied to them or vertically positioned mines which are detonated by a manual switch. Conventional mines explode only once.

Consequently, a vertically positioned or such other mine is detonated manually, i.e., someone has to pull the string to detonate the mine. So, this requires that someone has to be positioned essentially close to the mine in order to see the right moment to detonate it. Hence, being positioned within a close proximity of the enemy and the threat to life it imposes are inevitable. So, an anti-tank mine or other type of mine which is detonated by a load only explodes once and, after it has destroyed itself, it is useless.

SUMMARY OF THE INVENTION

The purpose of the invention is to minimise the time spent within a close proximity of the enemy in a defense battle and in withdrawing from a battle as well as to surprise the enemy in a situation where the enemy can assume to have already carried out, or be soon through with, a successful attack. In other words, the enemy has, in part or in whole, passed the location of an apparatus according to the invention at which time the apparatus only sets off, starting to fire the enemy from a direction the enemy regards essentially an improbable direction to be fired at from. Consequently, the purpose of the invention is also to cause confusion and panic.

Several apparatuses according to the invention can be placed in the same area and they can operate individually, independently of each other, or in unison, as a group. The dimensions and weight of an apparatus according to the invention can be such that a person can carry it, or even several of them, with him. On the other hand, the size of an apparatus according to the invention can also be such that its transportation requires machinery, for instance, a crawler lorry, helicopter, snowmobile, or such other means. Covered by a lead jacket, an apparatus according to the invention is hidden from a mine detector or such other device. Located under dirt cover, an apparatus according to the invention is also covered to a degree from firing. The thickness of the dirt cover can range from less than half a meter to over one meter. Also, when placed into the earth in front of a defense line and, for instance, of a trench, an apparatus according to the invention effectively surprises the attacker. Firing of grenades can be started from an apparatus according to the invention against all types of ground troops, such as men, tanks, crawler lorries, or the like; and against missiles with the possible targets of, in addition to the above-mentioned ones, air and naval force ships.

According to the invention, this objective can be achieved by using a cylinder mast hidden underground that can be opened, consisting of nested cylinders including an automatic weapon, a grenade thrower, fragmentation or other type of mine, or a group of missiles, or some other weapon. At the other end of the outermost cylinder, there is a drill or an auger or such other device, a so-called earth drill, rotated with a power device powered by a charged battery or an accumulator with the help of which the cylinder setup drills into the earth as it is pushed down from above at the same time. As an alternative, the drill can also be permanently fixed to the cylinder in which case drilling is done by rotating the cylinder and by pressing. In such a case, the power source used is a drilling unit equipped with a battery or an accumulator which has equipment to rotate the drill cylinder setup and to push it into the earth and which is handy, for instance, to transport with a helicopter or such other means. The operation of the drilling unit can also be such that it has its own drill which can be rotated and pushed in order to drill a hole into the earth. In such a case, the bottom end of the outermost cylinder can have a spring, e.g., a coil or gas spring, to alleviate the impact of the upper load. There are two or more nested cylinders. The cylinders are preferably made for the most part or in whole of titanium which is a relatively light and durable material; furthermore, titanium is hard to detect with a mine detector. The cylinders and other parts of the apparatus can also be made of aluminum or some other metal or plastic. The materials used are not limited to these. When opening, the nested cylinders form a telescope-like cylinder mast similar to the tipping gear of a tractor trailer or a lorry.

The cylinders according to the invention form a cylinder mast which differs from the aforementioned tipping gear system in the way that the power needed for creating a cylinder mast is charged inside the innermost cylinder in the form of excess pressure which, when discharging through a valve, a breakable plug, or the like located at either one end or both ends of the cylinder, makes the cylinders move longitudinally with respect to each other. The outermost cylinder is supported against the ground staying in place and the inner cylinder/cylinders moves/move. It is noteworthy that there can be one or more inner cylinders. There can also be a so-called inner tube inside the innermost cylinder which brings the valve close to the surface of the earth. There is a lid at the end of the cylinder tube that can be opened through which the weapon placed inside the cylinder is pushed into the right position in order to start firing at the enemy. If the innermost cylinder is of the type to have valves at both ends, then there are two of the next larger size cylinders, one of each at both ends of the innermost cylinder. Consequently, when the valves open, the excess pressure is discharged into both directions whereupon the telescope becomes longer in both directions.

As an alternative, the excess pressure can be loaded in all of the cylinders and the cylinders remain nested when the outermost and the innermost cylinder are bound together, e.g., with one or more tie(s), which tie can be either a bundle tie or the like at which point the telescope opens up when the tie is cut e.g. with an electric primer arrangement explained later on in this application.

As an alternative, the opening of the telescope can be realised together with, or instead of, the gas pressure energy by putting one or several compressed spring(s) inside the cylinders. In such a case, tying the cylinders inside each other and also releasing them from that tie is economic to realise in the manner explained in the previous paragraph.

When being drilled into the earth, the apparatus can be supported manually by using an installation tool to be connected to, and disconnected from, the apparatus or by using automation so that when the drill is rotating into the outer surface of the outermost cylinder, the shields prevent the cylinder from rotating together with the drill rotation into the opposite direction. The drilling can be started automatically so that when the drill point hits the ground, the transducer placed in it gives an order to the drill to start rotating. Furthermore, the drilling can be stopped by setting a certain number of revolutions to be drilled, by a certain earth resistance, or by using some other criterion.

BRIEF DESCRIPTION OF THE DRAWINGS

More precisely, characteristic to the apparatus according to the invention is what is presented in Patent claims 1 and 6 as being characteristics to it.

The following is a closer description of the invention with references to the drawings where.

DESCRIPTION OF THE PREFERRED EMBODIMENTS

Figure 1:
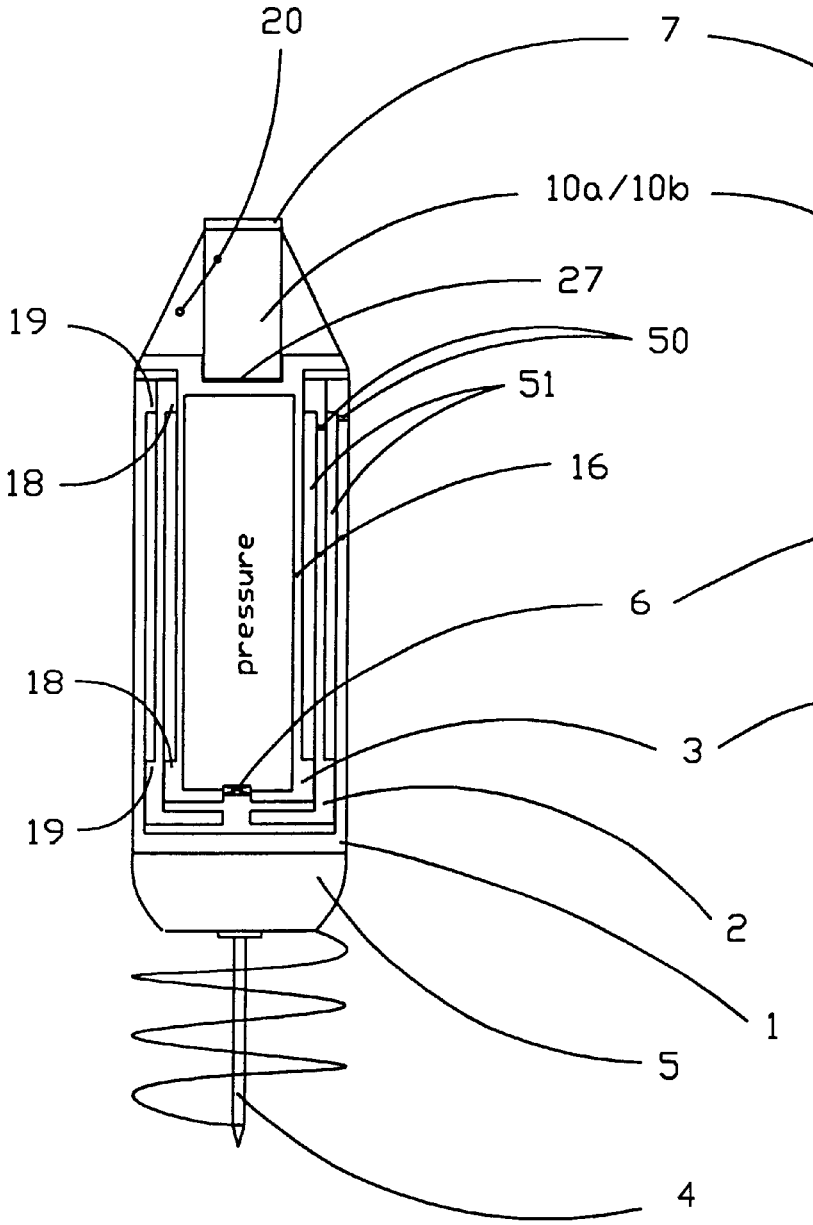
FIG. 1 presents an apparatus according to the invention with the cylinders packed in a shortened form and in a partial cross-sectional drawing.
Figure 2:
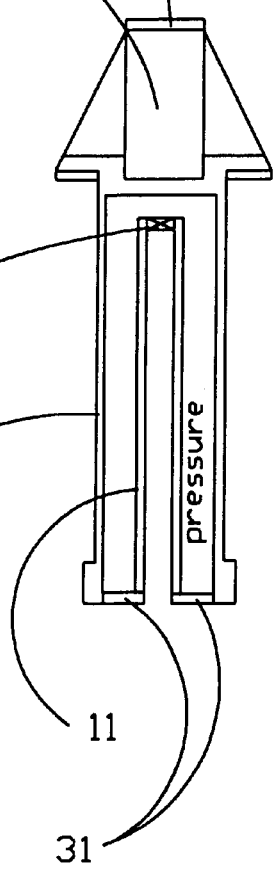
FIG. 2 presents the interior tube system in an apparatus according to the invention in a partial cross-sectional drawing.

With reference to FIGS. 1–2, the drill (4), attached to a first end of the outer cylinder (1), pushed from above and rotated with a power device (5), drills into the earth, preferably so deep that it can be covered without essentially changing the height of the earth surface. The pressure of the pressurised inner cylinder (3) is discharged into the middle cylinder (2) and outer cylinder (1) at the first end, i.e., the drill (4) end of the inner cylinder (3), or with a flange (31) and interior tube system (11) method through a valve (6), either a magnet valve or other valve located at the end opposite to the side of the drill (4).

The valve (6) is opened automatically with a remote control unit, either a manual unit or a transducer, switched on by exciter current. At that point, the cylinder setup (16), consisting of an inner cylinder (3), a middle cylinder (2) and an outer cylinder (1), opens so that the inner cylinder (3) comes out of the middle cylinder (2) to the extent allowed by the stoppers (18) and the middle cylinder (2) comes out of the outer cylinder (1) to the extent allowed by the stoppers (18), forming a telescope-like cylinder mast (17), FIG. 3.

The gas in the space (51) between the pair of stoppers (18 and 18) as well as the outer cylinder (1) and the middle cylinder (2) and also the space (51) between the pair of stoppers (19 and 19) as well as the middle cylinder (2) and the inner cylinder (3) is discharged through the channels (50) from the cylinder setup as the cylinders change from the shortened form over to the elongated form.

In FIG. 1, the cylinder setup (16) is packed for transportation. At that point, the weapon container's (20) protective lid (7) and the protective plates (10*a* and 10*b*) are in place. The apparatus is taken to the site in its transportation form and placed into the earth.

Figure 3:
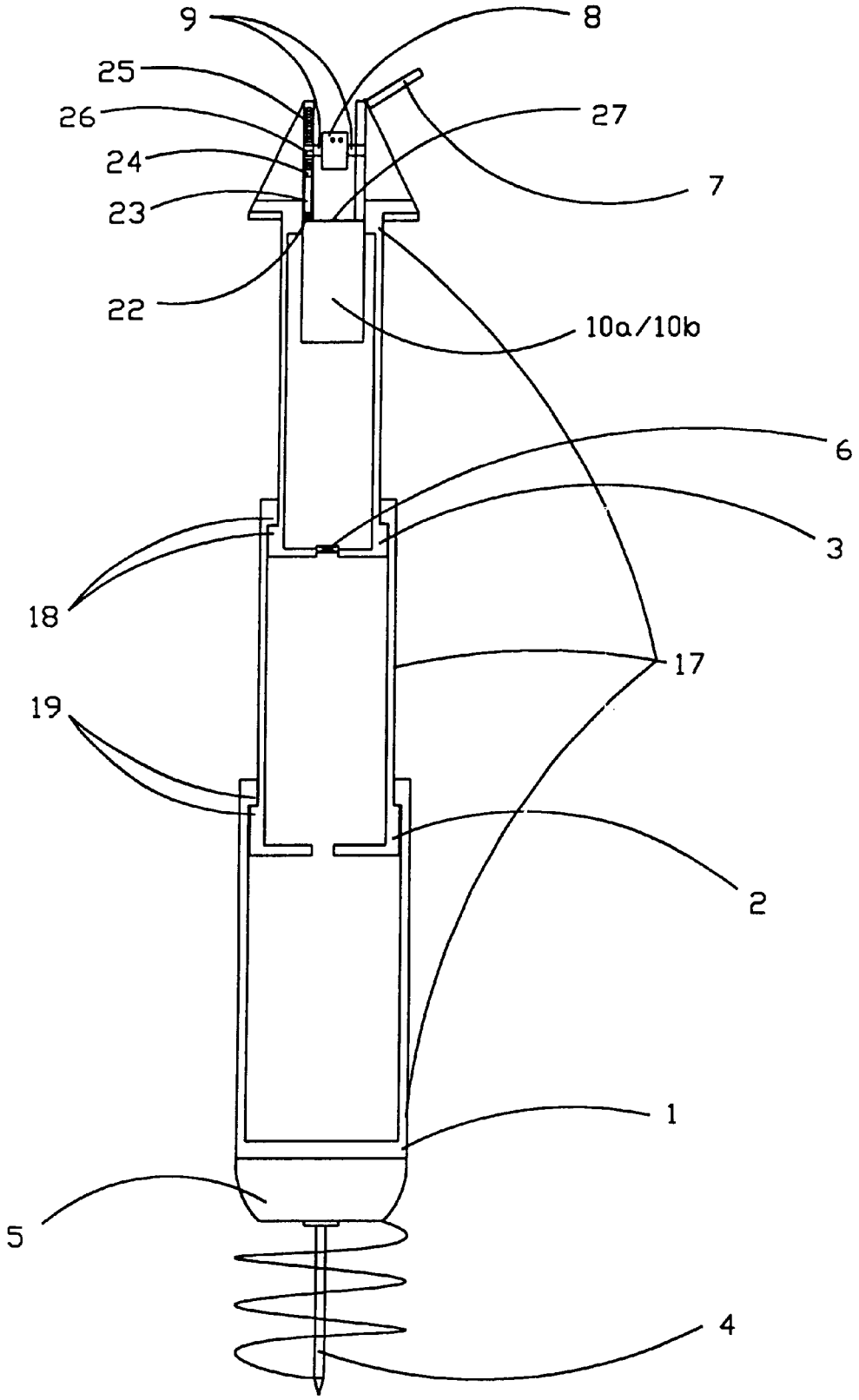
FIG. 3 presents an apparatus according to the invention in a partial cross-sectional drawing, with the cylinders opened to the elongated form and equipped with an automatic weapon.
Figure 4A:
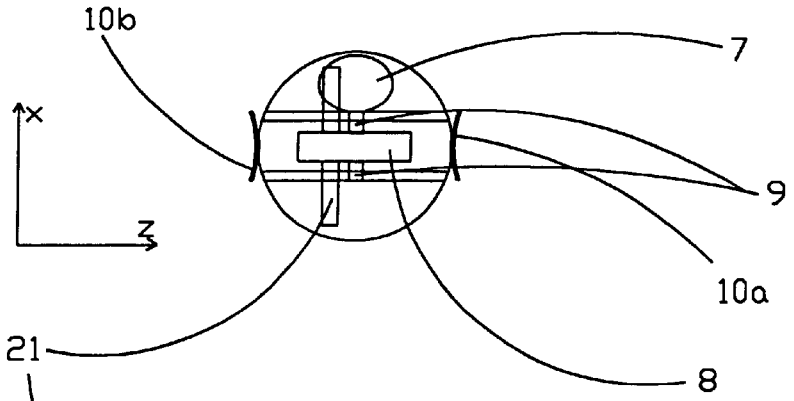
FIGS. 4*a*–4*c* present an automatic weapon system in an apparatus according to the invention in a partial cross-sectional drawing, projected on a level in a parallel direction with the given co-ordinate shafts.
Figure 4B:
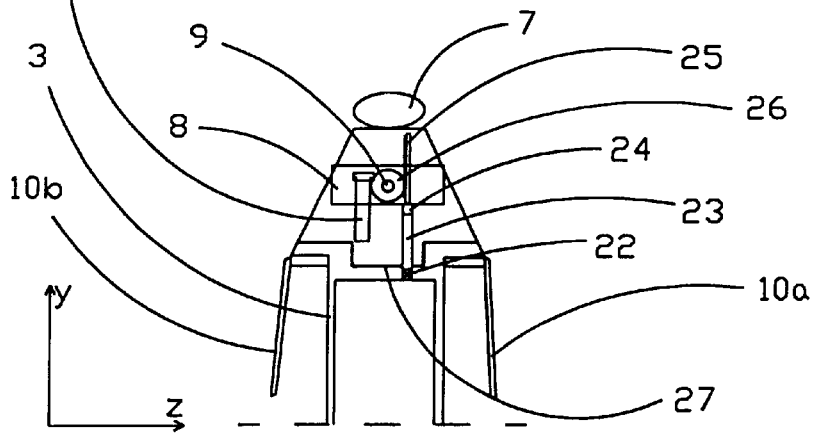
Figure 4C:
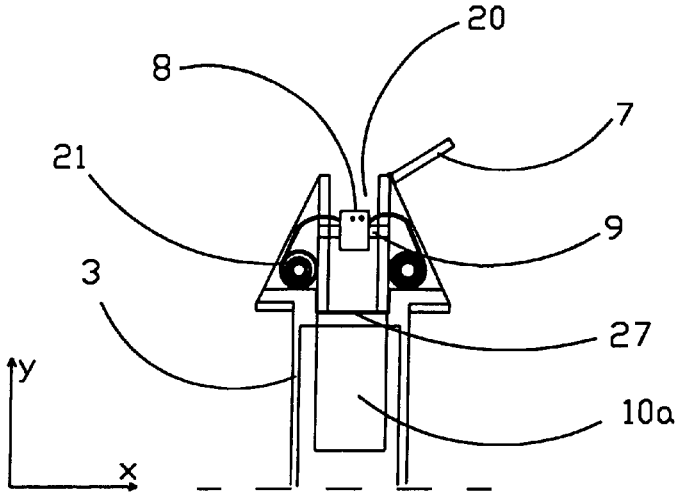

In FIG. 3, the automatic weapon (8) is turned to the firing position at which point its barrel or barrels are vertically positioned with respect to the cylinder mast. The valve (22), which operates with time delay, discharges pressure into the operating cylinder (23) where the piston (24) and the gear rail (25) attached to it move upwards. The valve, which operates with time delay, is used for the reason that the cylinder mast (17) has enough time to get into an erect position before bringing the weaponry into the firing position. At that point, the shaft (9), attached to the gear (26) which is rotated by the gear rail (25), turns the automatic weapon into the firing position, i.e., turned around the shaft (9) essentially to a lateral position with respect to the transportation position. With its movement, the automatic weapon, when turning into the firing position, opens the protective lid (7) and the protective plates (10*a* and 10*b*), allowing the cases eject freely from the weapon and ventilation is better. Firing starts mechanically after the weapon turns into the firing position and continues until the ammunition belts (21) are empty. See FIGS. 4*a*–4*c*. The non-centrally located barrel/barrels enables/enable the weapon to rotate around the mounted, recoil-powered rotation shaft (27) which is parallel with the cylinder mast; consequently, the enemy is subject to firing regardless of on which side of the apparatus it is located.

Figure 5:
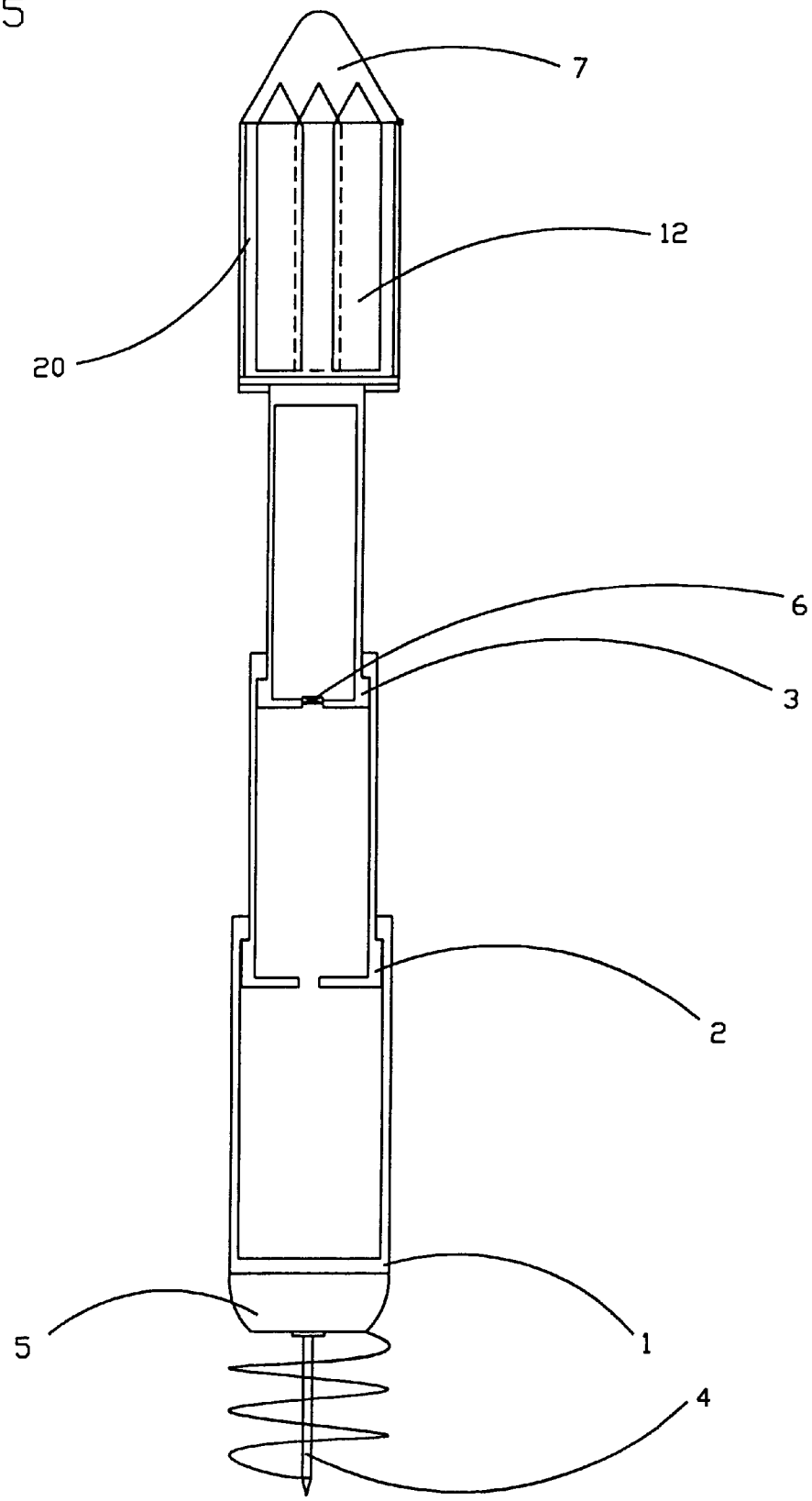
FIG. 5 presents a missile group system in an apparatus according to the invention, in a partial cross-sectional drawing.
Figure 6A:
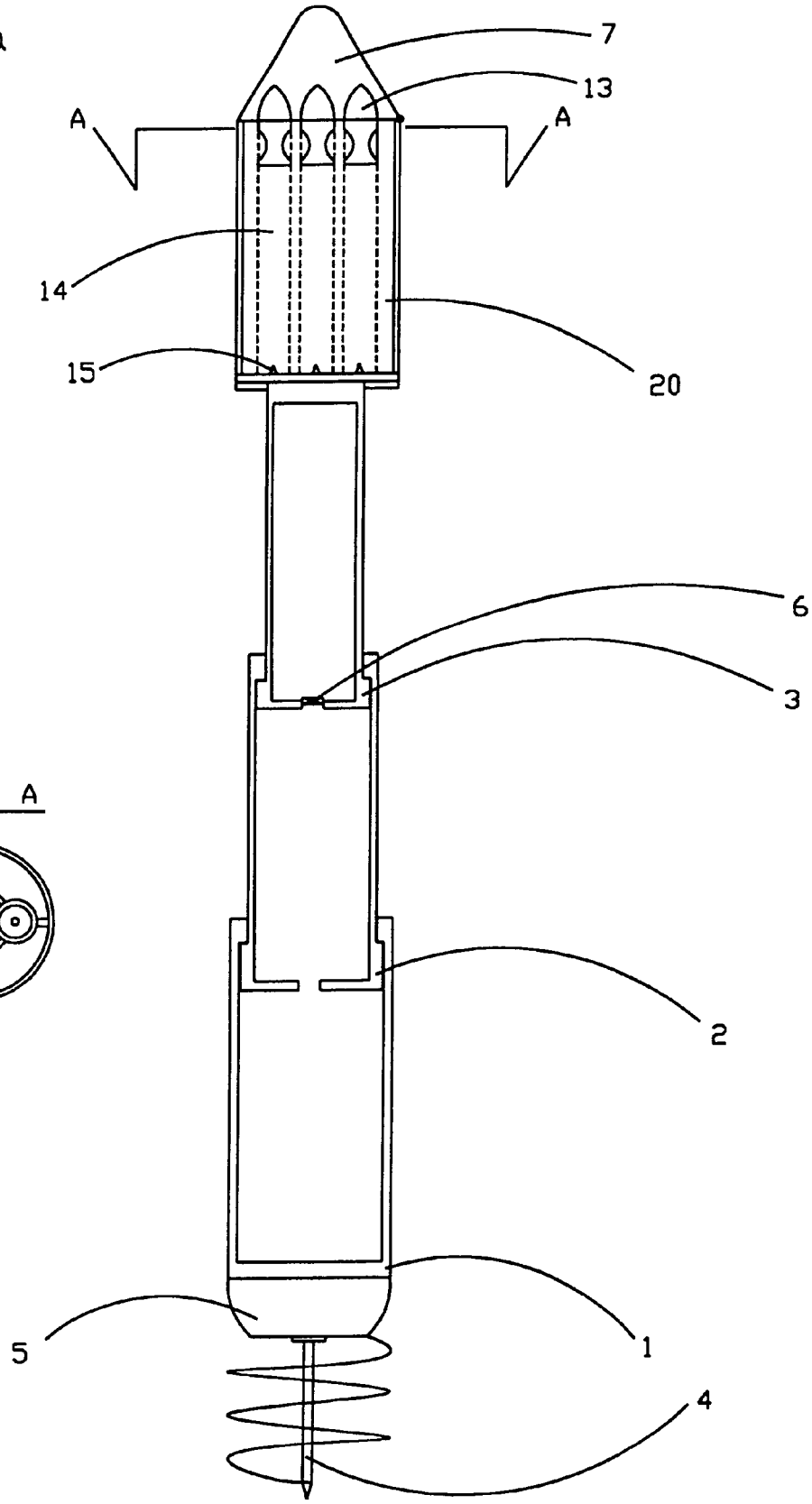
FIGS. 6*a*–6*b* and 7*a*–7*b* present a grenade thrower system in an apparatus according to the invention, in a partial cross-sectional drawing.
Figure 6B:
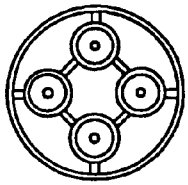
Figure 7A:
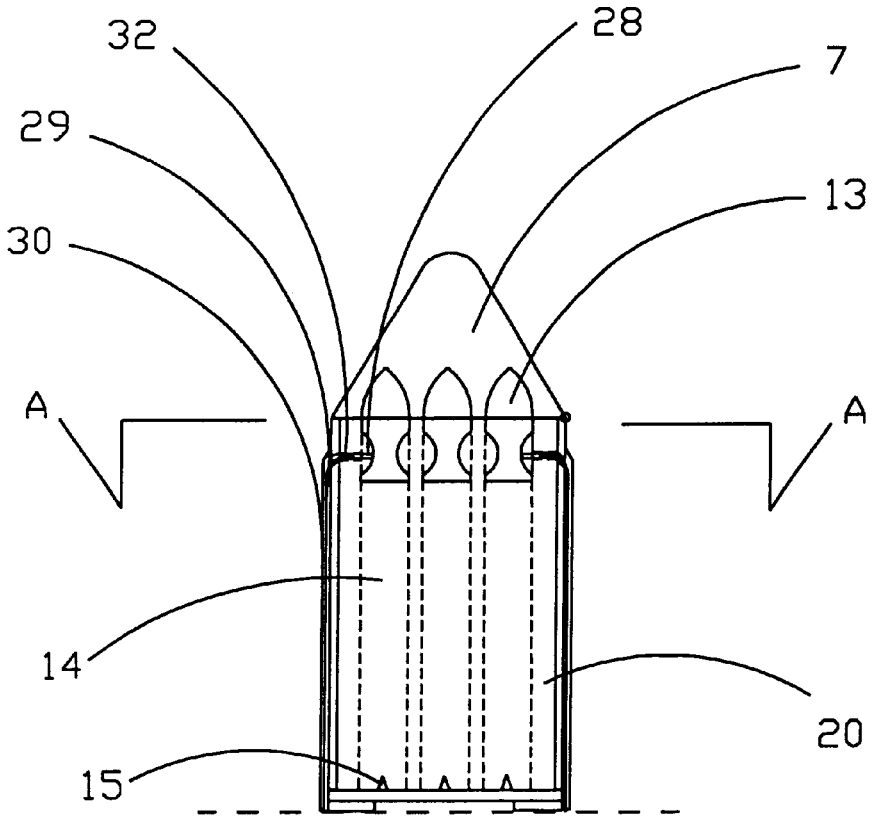
Figure 7B:
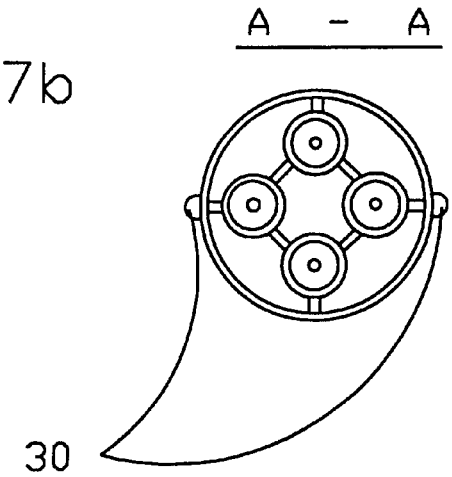

FIG. 5 shows an application of the invention where the weapon container (20) is equipped with a missile/missiles (12). The operation of the missiles (12) is electronically started and they are automatically directed at their target which can be either on land, at sea, or in the air.

FIGS. 6*a*–6*b* and 7*a*–7*b* show an application of the invention where the weapon container (20) is equipped with a grenade thrower. The grenade/grenades (13) is/are attached to the upper end of the tube (14) with a spring (32) or the like, suspended with a locking pin (28). As the cylinder setup (16) opens up into a cylinder mast (17), the string, wire or cable (29) placed inside the channel (30) pulls the locking pin (28) from supporting the grenade/grenades (13) whereupon the grenade (13) falls down to the bottom end of the tube (14) where the firing pin (15) fuses the primer located at the bottom end of the grenade (13) and the grenade goes up in the air. The grenade (13) used can be a fragmentation grenade or other type of grenade.

Figures 8A, 8B:
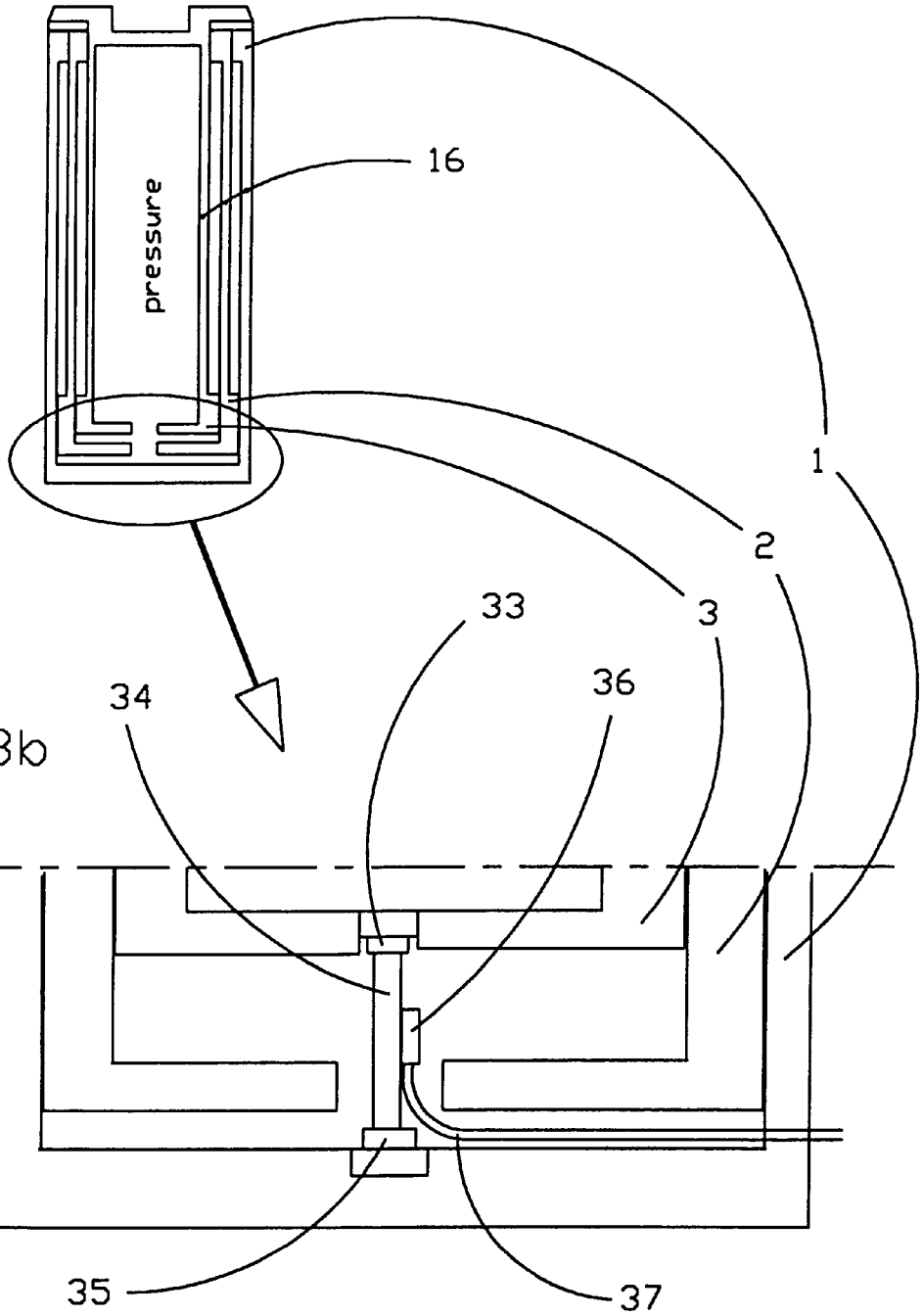
FIGS. 8*a*–8*b* present an application of the apparatus according to the invention in a partial cross-sectional drawing where the means to restrain the pressure energy is a tie and the means to release it is the ammunition.

FIGS. 8*a*–8*b* present an application of the invention where, to release the pressure energy from the inner cylinder (3), a pressure pipe (34) is used which is connected to the inner cylinder (3) with a connector (33) and also a connector (35) is used which is connected to the other end of the pipe (34), which connector is connected to the bottom end of the outer cylinder (1), e.g., to the flange, the end plug, or the kind. Inside the connectors (33 and 35), which connectors (33 and 35) can also be bead, tapered, or such other connectors, as well as inside the pipe (34), which pipe is made of plastic, glass fibre or such other material, there is a continuous channel from the inner cylinder (3) which also has excess pressure like the inner cylinder (3). An explosive agent (36) is fastened onto the outer wall of the pipe (34) which explosive agent (36) is an electric primer with a portion of gunpowder or sulphur, the ignition end of a match or such other essentially easily and/or quickly ignitable material attached to it. This explosive agent, preferably an electric primer, etc., is detonated by feeding an electrical current through the wires (37), whereupon the pressure in the pipe (34), in the connectors (33 and 35), and also in the inner cylinder (3) is discharged into the inner space of the outer cylinder (1) and possible middle cylinders (2), thereby causing the telescopic opening. The feeding of this electric impulse is preferably remotely controlled. Also other forms of feeding the electric impulse can be used. Gunpowder, sulphur, etc. can also be put inside the pipe (34).

Figure 9A:
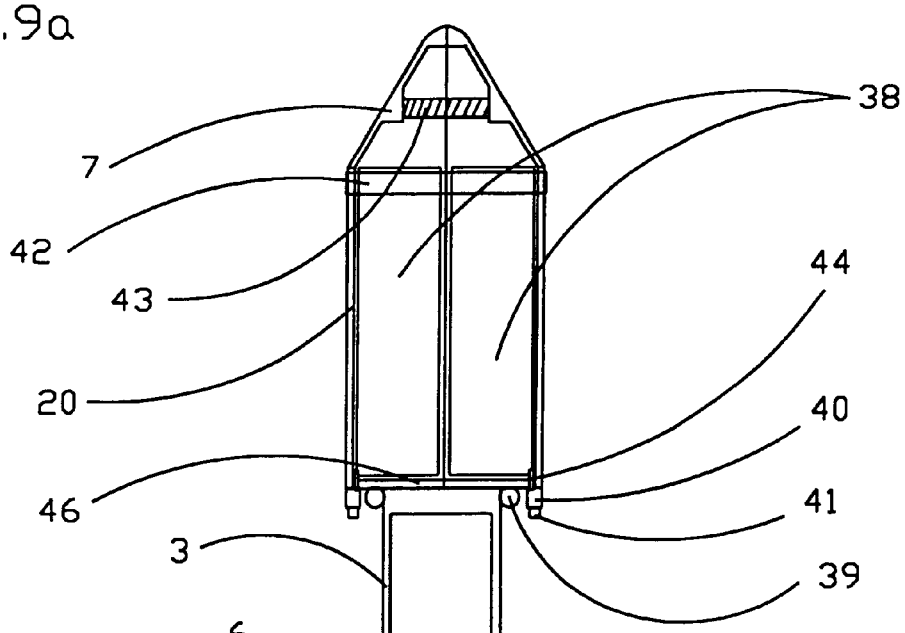
FIGS. 9*a*–9*b* present a fragmentation mine system in the apparatus according to the invention when in transport and when getting ready to explode in a partial cross-sectional drawing.
Figure 9B:
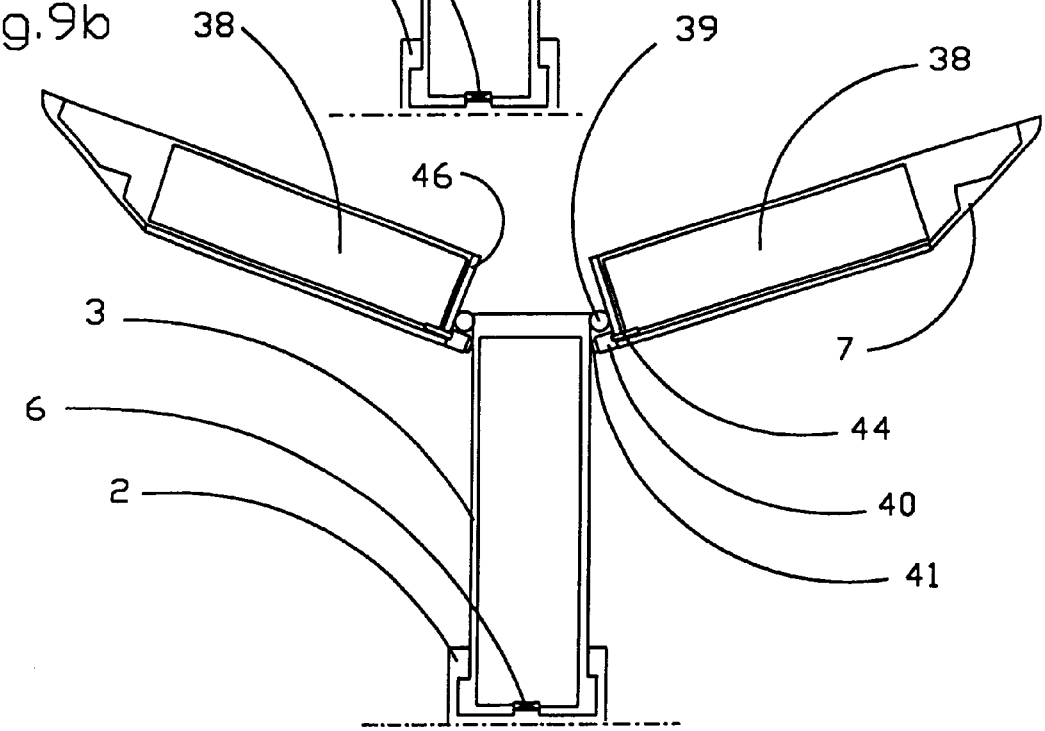

FIGS. 9*a*–9*b* present an application of the invention where the weapon container is equipped with a fragmentation or other type of mine (38). In the transport position, the halves, or parts, of the weapon container are against each other and bound together with a transport locking pin (42), preferably a strap, a belt, or the like. When the apparatus is put in place completely or to the extent that the halves, or parts, of the weapon container (20), supported by soil or such other means, can no longer essentially tilt sideways, the transport locking pin (42) is removed. When the apparatus is activated and the weapon container (20) goes up from the side support, the halves, or parts, of the weapon container (20), are detached from each other, thrust by the movement and/or gravity and/or the spring(s) (43), and turn crosswise in relation to the movement of the telescope, preferably around the shafts (39) attached to the base plates (46) of the weapon container and to the inner cylinder (3) whereupon the switches (41) of the triggers (40) attached to the bottom end of the weapon container (20), when hitting the outer surface of the inner cylinder (3), sink inside the triggers (40), at this point triggering the detonators (44) connected to the triggers (40) which further detonate the fragmentation or other types of mines placed in the weapon container (20).

Figure 10:
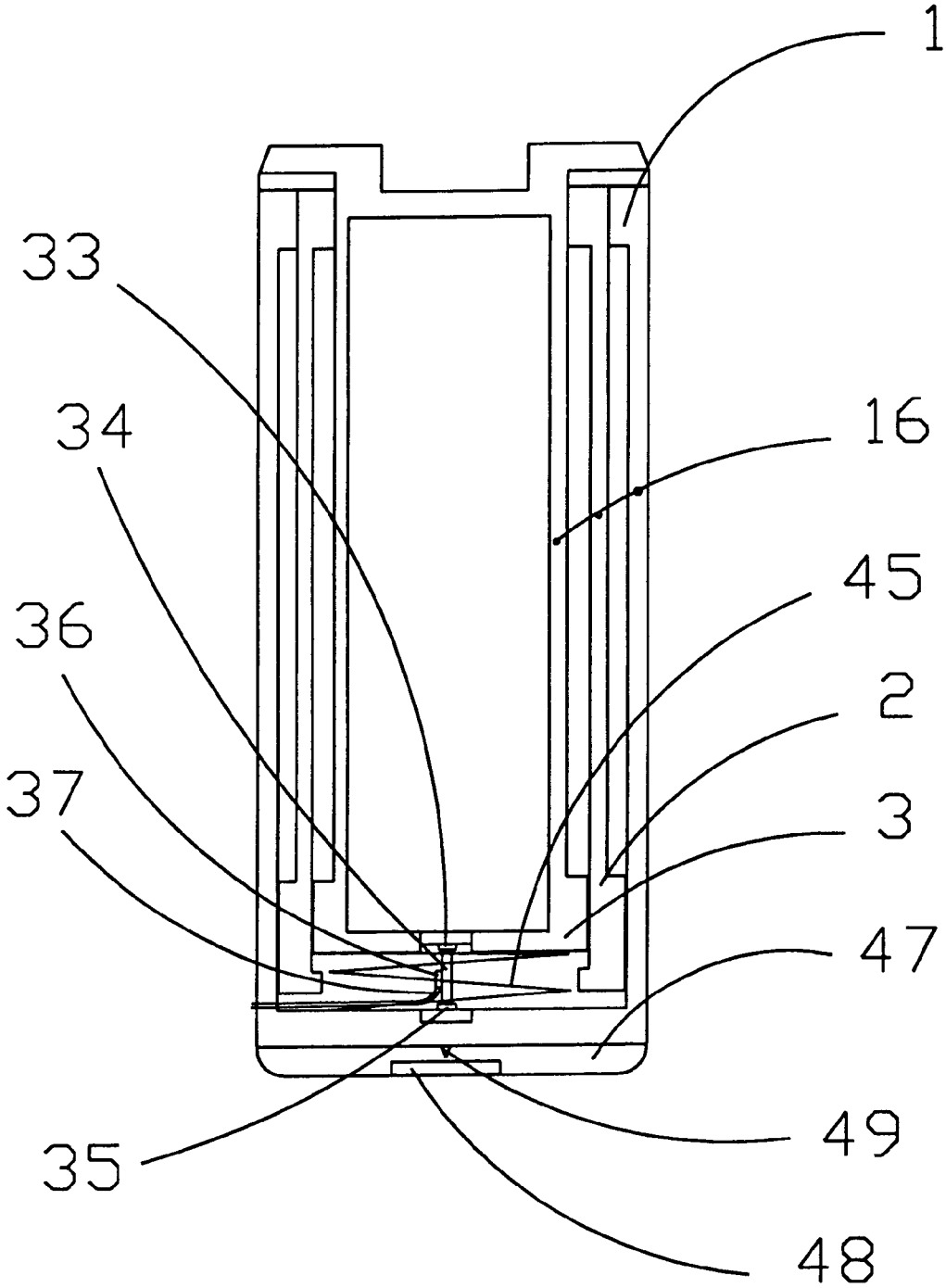
FIG. 10 presents an application of the apparatus according to the invention in a partial cross-sectional drawing where a drawn spring is the thrusting power, the tie is the restrainer, and the explosive agent is the releaser. The figure also shows a gas spring system application of the apparatus in a partial cross-sectional drawing.

FIG. 10 presents an application of the invention where the cylinder unit (16), consisting of the inner cylinder (3), the middle cylinder (2), and the outer cylinder (1), is packed into a shortened form, with a spring (45) drawn between-the ends of the inner cylinder (3) and the outer cylinder (1), which spring (45) is intended for pushing the cylinders from inside each other into a cylinder mast (17). The implement keeping the cylinders in the shortened form is a binding tie (34) with pulling stress, which is connected to the other end of the inner cylinder (3) with a connector (33) and to the other end of the outer cylinder (1) with a connector (35), and which tie can be a pipe, a bundle tie, or the like. An explosive agent (36) is attached to the tie (34), which explosive agent (36) is an electric primer, with a portion of gunpowder or sulphur, the ignition end of a match, or such other essentially easily and/or quickly ingnitable material attached to it. This explosive agent, preferably an electric primer, etc., is detonated by feeding an electric current through the wires (37), whereupon the tie (34) is broken and the cylinders change over to the elongated form of a cylinder mast (17). This feeding of an electric impulse is preferably remotely controlled. Also other forms of feeding the electric impulse can be used. The figure also shows an application of the invention where there is a spring system attached to the bottom end of the outer cylinder (1) which spring can be either a compressible coil spring or gas spring. In case of a gas spring, the spring system consists of a bag (47) made of rubber or other stretch material containing, and/or attached to it, a cartridge (48) containing carbonic acid or other pressurised gas. The cartridge breaks when the apparatus is pushed into the earth with certain pressure, whereupon a spike (49), or the like, placed inside the bag (47) which is also attached to the bottom surface of the outer cylinder (1), penetrates the casing of the cartridge (48). At this point, the excess pressure is discharged from the cartridge (48) into the bag (47), which bag (47), upon expanding, forms a gas spring to alleviate the impact of the upper load.

In all application examples, the firing operation can be managed manually with a remote control unit or automatically with a transducer giving an impulse to start it. At the end of the firing, each application is detonated with the help of a blasting charge placed inside the apparatus which operates with time delay.

The operation of an automatic weapon, grenade, missile, fragmentation mine, and other types of mines and weapons is already known to everybody so they are not explained here in more detail. The application examples are intended for illustrating the invention, without restricting it in any way.

We claim:

1. A defense apparatus, comprising:

a telescopic cylinder mast comprised of at least an inner cylinder nested in an outer cylinder, the inner and outer cylinders being movable relative to each other between a shortened state and an elongated state, in the shortened state, the inner cylinder being pre-pressurized with pressurized gas;

a remotely-controlled pressure releasing apparatus connected to the inner cylinder for releasing the pressurized gas from the inner cylinder and passing the pressurized gas to the outer cylinder for elongating the telescopic cylinder mast from the shortened state to the elongated state; and a defense system fitted to a first end of the inner cylinder.

2. The defense apparatus of claim 1, wherein the pressure releasing apparatus comprises a valve which can be opened by a remote control switch to release the pressurized gas from the inner cylinder and pass the pressurized gas to the outer cylinder for elongating the telescopic cylinder mast from the shortened state to the elongated state.

3. The defense apparatus of claim 1, wherein the pressure releasing apparatus comprises:

a sealed pipe connected at a first end to the inner cylinder;

the sealed pipe (34) having a second end in proximity to the outer cylinder, the sealed pipe being sealed at the second end;

a connector (33) arranged in the sealed pipe at the first end to provide a path for pressurizing the inner cylinder; and a remotely-controlled device (36) attached to a surface of the sealed pipe to be activated for opening the sealed pipe to release the pressurized gas from the inner cylinder and pass the pressurized gas to the outer cylinder for elongating the telescopic cylinder mast from the shortened state to the elongated state.

4. The defense apparatus of claim 3, wherein, the telescopic cylinder mast comprises at least a middle cylinder nest between the inner cylinder nested and the outer cylinder, the sealed pipe is a plastic or fibreglass pipe, the remotely-controlled device is an explosive agent (36).

5. The defense apparatus of claim 1, wherein, the pressure releasing apparatus comprises:

a binding tie (34) connected at a first end to the inner cylinder and at a second end to the outer cylinder, the binding tie sealing an opening to the inner cylinder and an opening to the outer cylinder; and a remotely-controlled device (36) attached to a surface of the binding tie to be activated for releasing the binding tie and opening the inner cylinder and the outer cylinder to release the pressurized gas from the inner cylinder and pass the pressurized gas to the outer cylinder for elongating the telescopic cylinder mast from the shortened state to the elongated state; and a spring (45), positioning around the binding tie, the spring biased to assist in elongating the telescopic cylinder mast from the shortened state to the elongated state.

6. The defense apparatus of claim 1, wherein, the cylinder mast comprises at least three cylinders; and the cylinders comprises stoppers (18 and 19) positioned on lower ends of some of the cylinders and upper ends of some of the cylinders, the stoppers of the cylinders engaging each other to restrict longitudinal movement during elongating the telescopic cylinder mast from the shortened state to the elongated state at the point where each cylinder is nested inside each other with the lower end of a first of the cylinders being in proximity with an upper end of a second of the cylinders.

7. The defense apparatus of claim 1, wherein, the inner cylinder comprises an interior tube with a valve at the first end of the inner cylinder and a sealing flange at an opposite, second end of the inner cylinder, the valve being part of the remotely-controlled pressure releasing apparatus so that when the valve is opened, pressurized gas in the inner cylinder is released and passed to the outer cylinder for elongating the telescopic cylinder mast from the shortened state to the elongated state.

8. The defense apparatus of claim 1, wherein, the defense system is a weapon, and the first end of the inner cylinder comprises a weapon container for storing the weapon.

9. The defense apparatus of claim 8, wherein, the weapon container comprises a grenade thrower tube (14) with a grenade firing pin (15) located at a bottom portion of the tube and a lid located at an upper portion of the tube, and the weapon stored in the weapon container comprises plural grenades.

10. The defense apparatus of claim 1, wherein, the weapon container comprises an operating cylinder, a pressure-operated piston (24) located in the operating cylinder, a time delay valve (22) connected to the pressure-operated piston, and a gear rail (25) attached to the pressure-operated piston (24), a gear engaged with the gear rail, and a shaft inserted into the gear, the shaft supporting the weapon, the gear rail, gear and shaft arranged for turning the automatic weapon to a firing position.

11. The defense apparatus of claim 10, wherein, the weapon is an automatic weapon with a barrel, and the weapon container further comprises a recoil-powered rotation shaft, the barrel of the automatic weapon (8) being mounted non-centrally in relation to a longitudinal axis of the cylinder mast in order for the weapon to be able to rotate with recoil around the rotation shaft.

12. The defense apparatus of claim 8, wherein, the weapon is a missile mounted essentially parallel with the cylinder mast, the missile being remotely launchable.

13. The defense apparatus of claim 8, wherein, the weapon is grenade launcher with grenades, and the weapon container further comprises a grenade thrower tubes (14) mounted essentially parallel with the cylinder mast, the grenades supported within the tubes by a locking pin, and firing pins located at a lower portion of the thrower tubes.

14. The defense apparatus of claim 13, wherein, the locking pin is connected to the inner cylinder by a line that, upon movement of the inner cylinder, pulls the locking pin from supporting the grenades whereupon the grenades fall down to the lower portion of the thrower tubes and contact the firing pins, thereby firing the grenades.

15. The defense apparatus of claim 8, wherein, the weapon is mine system, and the weapon container further comprises two or more longitudinal sections, each section having at a first end a base plate supporting an individual mine and having at a second end a protective lid (7);

the base plate of each section being pivotably fastened to the inner cylinder with a shaft (39) mounted in a transverse direction in relation to a direction of the inner cylinder's movement.

16. The defense apparatus of claim 15, wherein, the weapon container (20) further comprises triggers mounted on the base plates, springs placed between the lids, the springs biased to push apart the longitudinal sections, switches mounted at the second end of the sections, the switches being located so that upon the longitudinal sections being pushed apart, the longitudinal sections turn around the shafts and bring the switches in contact with the triggers exploding the mines.

17. The defense apparatus of claim 1, further comprising:

a drill (4) mounted at a bottom end of the telescopic cylinder mast, the drill connected to a power device (5) operating with a battery, the drill positioned for drilling a hole into the earth to protect the apparatus within the hole.

18. The defense apparatus of claim 17, wherein, the drill (4) is permanently fixed to the bottom end of the mast.

19. A defense apparatus, comprising:

a telescopic cylinder mast comprised of at least an inner cylinder nested in an outer cylinder, the inner and outer cylinders being movable relative to each other between a shortened state and an elongated state;

a remotely-controlled pressure releasing apparatus connected to the inner cylinder for releasing a pressurized gas into the inner cylinder and into the outer cylinder for elongating the telescopic cylinder mast from the shortened state to the elongated state;

a bag attached to a bottom end of the telescopic cylinder mast, the bag comprising a cartridge (48) housing the pressurised gas, and a spike (49) positioned proximate the cartridge for breaking the cartridge and discharging the pressurised gas; and a defense system fitted to a top end of the inner cylinder.

20. The defense apparatus of claim 1, wherein, the telescopic cylinder mast is configured so that in changing from the shortened state to the elongated state, the inner cylinder moves upward before the outer cylinder moves.

* * * * *